US011041615B2

(12) United States Patent
Evans

(10) Patent No.: US 11,041,615 B2
(45) Date of Patent: Jun. 22, 2021

(54) LIGHT EMITTING DIODE (LED) LIGHTING SYSTEM

(71) Applicant: EvansWerks, LLC, New Berlin, WI (US)

(72) Inventor: Justin E. Evans, New Berlin, WI (US)

(73) Assignee: ANTHEM ONE, INC., New Berlin, WI (US)

( * ) Notice: Subject to any disclaimer, the term of this patent is extended or adjusted under 35 U.S.C. 154(b) by 0 days.

(21) Appl. No.: 16/776,310

(22) Filed: Jan. 29, 2020

(65) Prior Publication Data

US 2020/0240625 A1 Jul. 30, 2020

Related U.S. Application Data

(60) Provisional application No. 62/798,318, filed on Jan. 29, 2019.

(51) Int. Cl.

| | |
|---|---|
| ***F21V 29/80*** | (2015.01) |
| ***F21V 19/04*** | (2006.01) |
| ***F21V 29/67*** | (2015.01) |
| ***F21Y 115/10*** | (2016.01) |

(52) U.S. Cl.
CPC ..... *F21V 29/80* (2015.01); *F21V 19/04* (2013.01); *F21V 29/67* (2015.01); *F21Y 2115/10* (2016.08)

(58) Field of Classification Search
CPC ..... F21V 29/67; F21V 29/80; F21V 19/04
See application file for complete search history.

(56) References Cited

U.S. PATENT DOCUMENTS

| | | | | |
|---|---|---|---|---|
| 7,344,296 | B2 | 3/2008 | Matsui et al. | |
| 7,744,256 | B2 | 6/2010 | Smester | |
| 8,152,336 | B2 | 4/2012 | Alexander et al. | |
| 8,430,533 | B1 | 4/2013 | Blalock et al. | |
| 9,127,817 | B2 * | 9/2015 | Min | F21K 9/238 |
| 9,404,639 | B2 | 8/2016 | Bailey et al. | |
| 9,803,844 | B2 | 10/2017 | Chad | |
| 2007/0070645 | A1 * | 3/2007 | Coushaine | F21V 29/74 362/555 |
| 2010/0027276 | A1 * | 2/2010 | Kornitz | F21V 29/80 362/373 |

(Continued)

*Primary Examiner* — Alan B Cariaso
(74) *Attorney, Agent, or Firm* — Schmeiser, Olsen & Watts, LLP

(57) ABSTRACT

A light emitting diode (LED) lighting system allows for the maintenance and replacement of a light emitting diode-chip on board (LED-COB). Additionally, the LED lighting system allows an LED-COB to be electrified by traversing electrical conductors through a heat sink. The LED lighting system includes at least one illumination system, a plate cover, a substrate, a heat sink, and a direct current (DC) power supply. The at least one illumination system is the light source of the LED lighting system. The substrate combines with the at least one illumination system in order to form a LED-COB. The plate cover is used to fasten the substrate with the at least one illumination system to the heat sink. The heat sink is used to absorb and dissipate heat produced by the at least one illumination system. The DC power supply is used to electrify the at least one illumination system, and an electrical connection between the at least one illumination system and the DC power supply traverses through the heat sink.

18 Claims, 6 Drawing Sheets

(56) References Cited

U.S. PATENT DOCUMENTS

| | | | | |
|---|---|---|---|---|
| 2012/0176032 | A1* | 7/2012 | Chu | F21V 29/773 315/32 |
| 2013/0343056 | A1* | 12/2013 | Wilhelm | F21V 29/80 362/249.02 |
| 2014/0160772 | A1* | 6/2014 | Wu | F21S 8/02 362/373 |
| 2014/0213094 | A1* | 7/2014 | Rowlette | F21V 19/0035 439/366 |
| 2015/0109792 | A1* | 4/2015 | Ishida | F21K 9/60 362/294 |
| 2016/0003462 | A1* | 1/2016 | Zeng | F21V 29/67 362/373 |
| 2016/0025319 | A1* | 1/2016 | Meyer | F21V 23/006 362/382 |
| 2016/0084483 | A1* | 3/2016 | Dubuc | F21V 31/04 362/373 |
| 2016/0123569 | A1* | 5/2016 | Cummings | F21S 2/005 362/249.02 |

* cited by examiner

LIGHT EMITTING DIODE (LED) LIGHTING SYSTEM

The current application claims a priority to the U.S. Provisional Patent application Ser. No. 62/798,318 filed on Jan. 29, 2019.

FIELD OF THE INVENTION

The present invention relates generally to a light emitting diode (LED) lighting systems. More specifically, the present invention is a LED lighting system that allows for the maintenance and replacement of a light emitting diode-chip on board (LED-COB).

BACKGROUND OF THE INVENTION

In conventional lighting systems, light emitting diodes (LEDs) are permanently soldered to their substrate, often referred to as a printed circuit board (PCB) or metal core printed circuit board (MCPCB). PCBs come in many varieties; some rigid, some flexible, but all are considered PCBs. More specifically, some PCBs used in LED lighting system are referred to as a light emitting diode-chip on board (LED-COB). It should be noted that PCBs, MCPCBs, and LED-COBs can all be generically referred to as substrates. These substrates are electrified or electrically powered in order to cause the LEDs thereon to illuminate. Typically, when LED-COBs are manufactured, they have an exposed positive and negative junction (i.e., a P-N junction) on the "top side" (i.e., the side in which LEDs are affixed). This P-N junction includes a positive contact and a negative contact used for testing the LED-COB in testing chambers. The LED-COB is momentarily electrified or powered up. The testing chamber collects data on the light emitted and verifies that the LED-COB meets the applicable design specifications. These LED-COBs are typically incorporated in permanent housings, for example, streetlights, movie lights, light bulbs, etc., with electrical wiring permanently soldered to the P-N junction to the top side of the LED-COB. As a result, when the LEDs fail, the entire lighting is thrown away. This is somewhat analogous to disposing of an entire lamp every time a light bulb fails.

Therefore, it is an objective of the present invention to provide a LED lighting system that allows for the maintenance and replacement of a LED-COB. The present invention includes an arrangement of components that allows an individual to remove a faulty LED-COB in order to replace it with a new LED-COB. Additionally, the present invention allows an individual to use different LED-COBs when desired and/or upgrade to a newer model of LED-COBs. The present invention includes a means in order to electrify an LED-COB by traversing electrical conductors through a heat sink in a safe and efficient manner. Further, the present invention positions the positive and negative contacts to the the back side of an LED-COB.

DETAIL DESCRIPTIONS OF THE INVENTION

Figure 1:
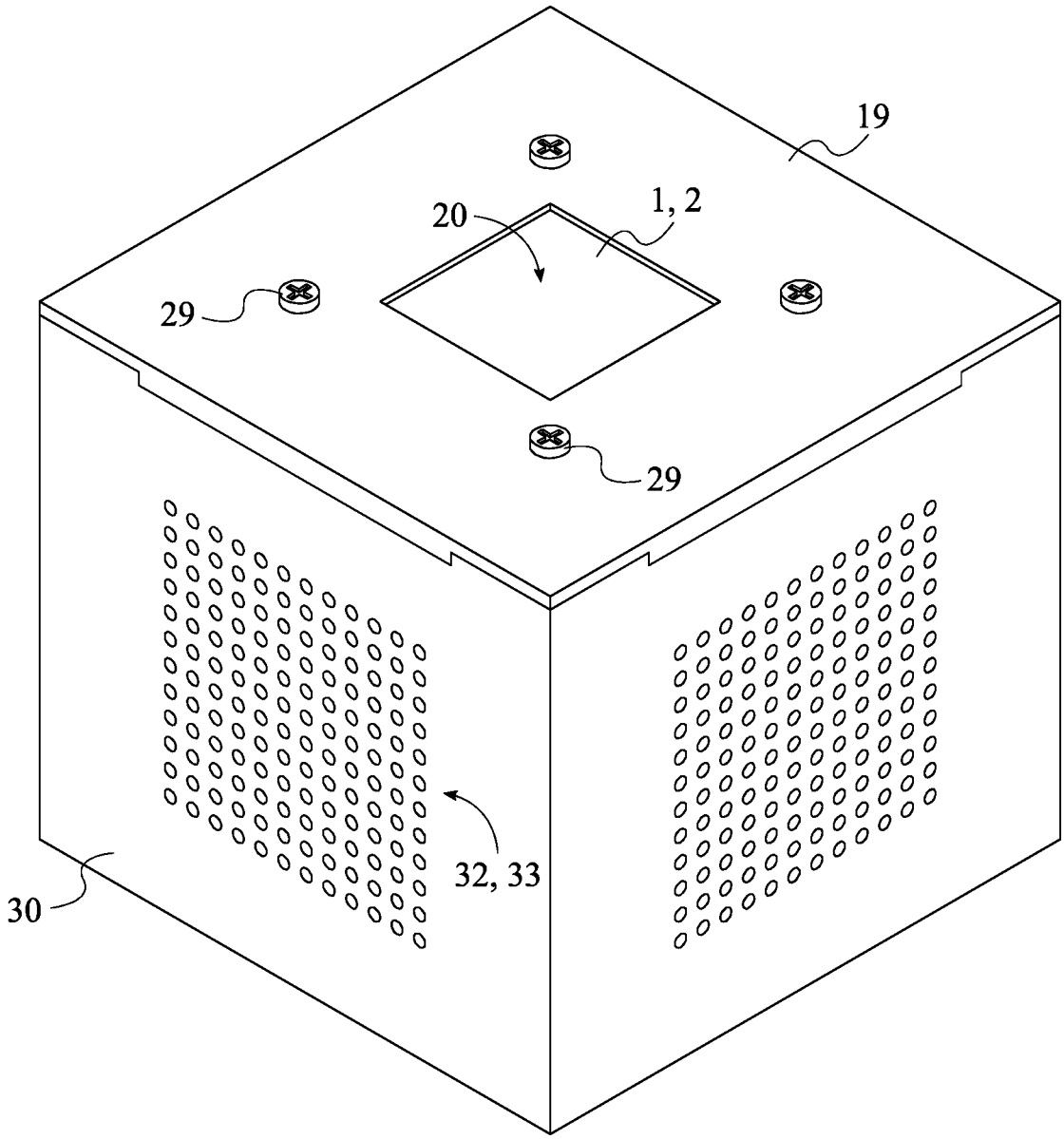
FIG. 1 is a perspective view of the present invention.

All illustrations of the drawings are for the purpose of describing selected versions of the present invention and are not intended to limit the scope of the present invention.

In reference to FIGS. 1 through 6, the present invention is a light emitting diode (LED) lighting system that allows for the maintenance and replacement of a light emitting diode-chip on board (LED-COB). Additionally, the present invention allows an LED-COB to be electrified by traversing electrical conductors through a heat transfer device. The present invention comprises at least one illumination system 1, a plate cover 19, a substrate 21, a heat sink 24, and a direct current (DC) power supply 28. The at least one illumination system 1 is the light source of the present invention. In further detail, the at least one illumination system 1 is an LED chip. The substrate 21 is preferably a printed circuit board and preferably combines with the at least one illumination system 1 in order to form a LED-COB. The plate cover 19 is used to protect and conceal substrate 21 with the at least one illumination system 1 and to fasten the substrate 21 with the at least one illumination system 1 to the heat sink 24. Further, the plate cover 19 is used to apply a compressive force to the substrate 21 with the at least one illumination system 1. The heat sink 24 is used to absorb and dissipate heat produced by the at least one illumination system 1. The DC power supply 28 is used to electrify the at least one illumination system 1. The DC power supply 28 may be a current rectifier which allows the present invention to be plugged into a power outlet or may be a portable energy source such as, but not limited to, a rechargeable battery.

Figure 2:
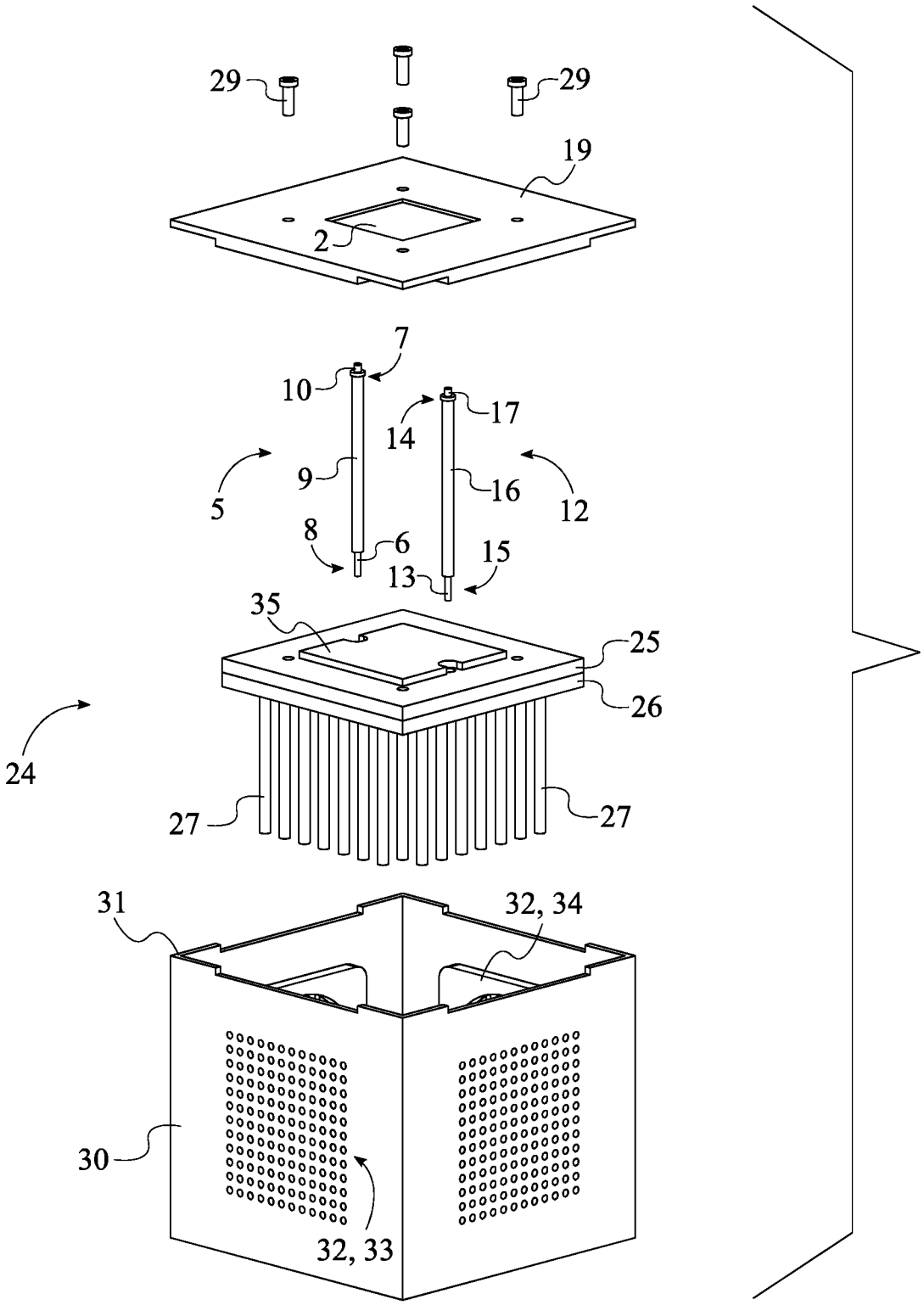
FIG. 2 is an exploded top perspective view of the present invention.
Figure 5:
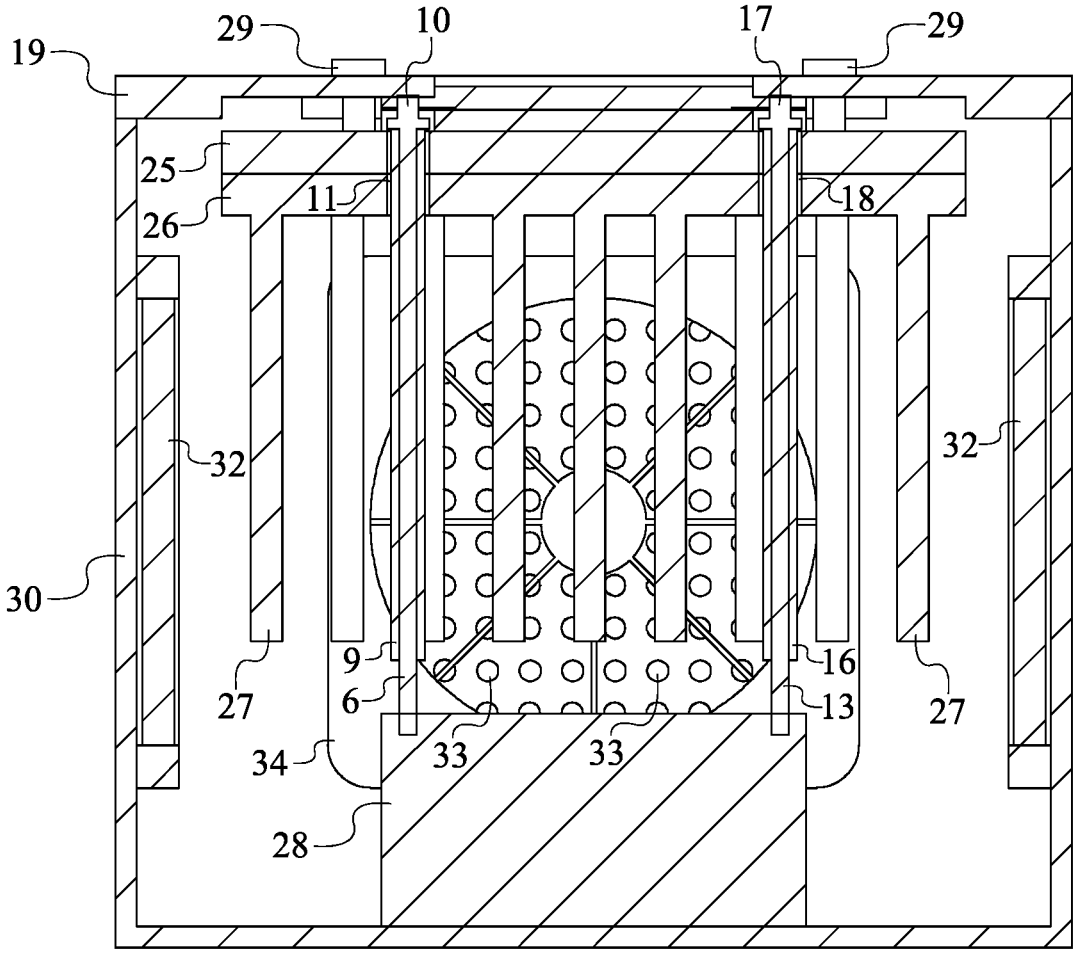
FIG. 5 is a cross-sectional view taken along line 5-5 from FIG. 4.
Figure 6:
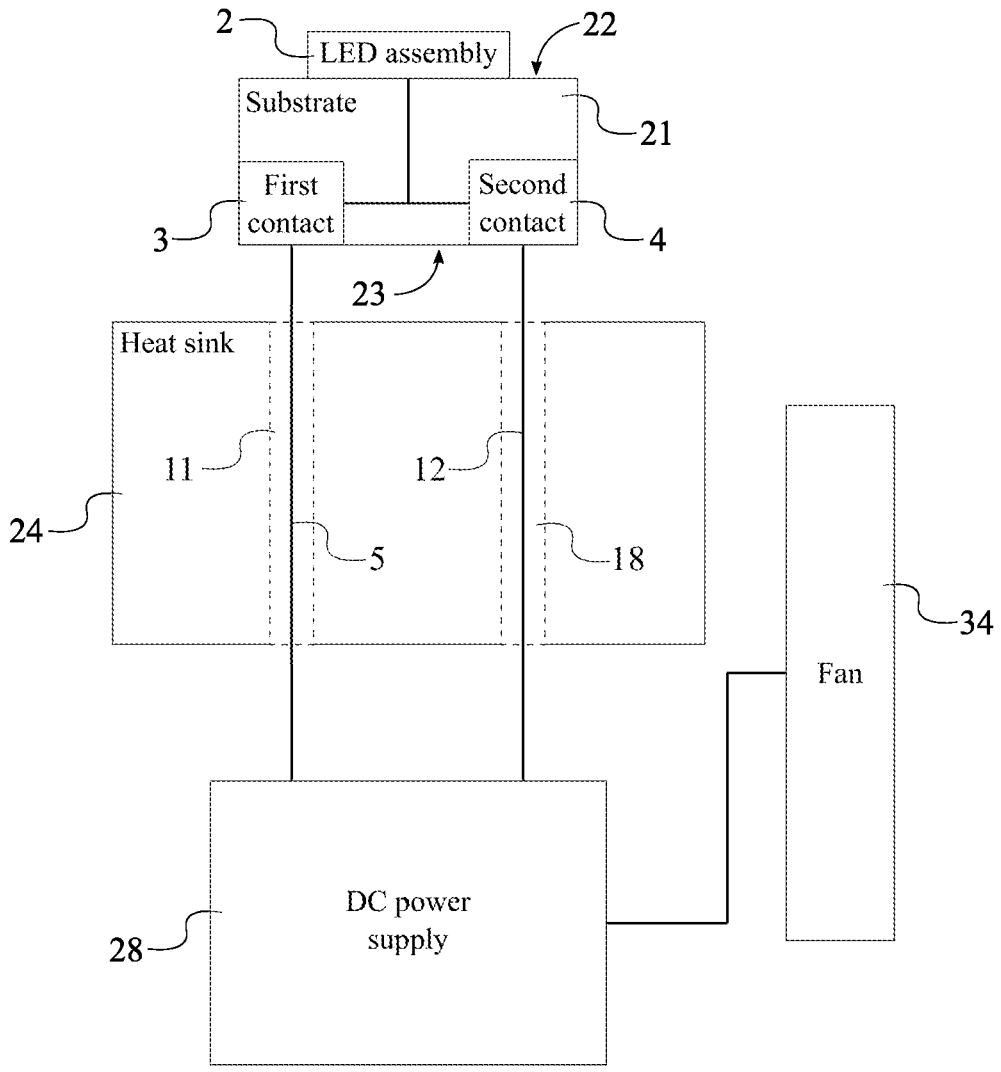
FIG. 6 is a schematic diagram displaying the electrical connections of the present invention.

The general configuration of the aforementioned components allows for the maintenance and replacement of a LED-COB. With reference to FIGS. 1 and 2, the at least one illumination system 1 comprises an LED assembly 2, a first contact 3, and a second contact 4. The LED assembly 2 is array of LEDs that forms the illuminating source of a LED chip. The first contact 3 and the second contact 4 is respectively the positive-negative junction of a LED chip. The substrate 21 comprises a first face 22 and a second face 23. The LED assembly 2 is mounted onto the first face 22, and the first contact 3 and the second contact 4 are mounted onto second face 23. This arrangement forms a LED-COB between the substrate 21 and the at least one illumination system 1. However, the positive-negative junction is on the second face 23 (backside) of the substrate 21 rather than the first face 22 (frontside) as found in conventional LED-COBs. The plate cover 19 is positioned adjacent to the first face 22, and the heat sink 24 is positioned adjacent to the second face 23. This arrangement positions the substrate 21 in between the plate cover 19 and the heat sink 24. Further, the substrate 21 is compressed in between the plate cover 19 and the heat sink 24 in order to mitigate any vibration produced when the LED assembly 2 is powered on. The LED assembly 2 is in thermal communication with the heat sink 24 in order for the heat sink 24 to absorb and dissipate heat produced by the LED assembly 2 when powered on. With reference to FIGS. 5 and 6, the DC power supply 28 is positioned adjacent to the heat sink 24, opposite to the second face 23. This arrangement positions the DC power supply 28 in order to power the substrate 21 through the heat sink 24. The first contact 3 and the second contact 4 are electrically connected to the DC power supply 28 in order for the DC power supply 28 to electrify the LED assembly 2. Moreover, the electrical connection between the first contact 3, the second contact 4, and the DC power supply 28 traverses through the heat sink 24. This arrangement eliminates the need to permanently solder the DC power supply 28 to the at least one illumination system 1.

With reference to FIGS. 1 and 2, the present invention may further comprise a releasable attachment mechanism 29 in order to fully secure the plate cover 19 to the heat sink 24 and, thus, to also secure the substrate 21 with the at least one illumination system 1 to the heat sink 24. The releasable attachment mechanism 29 is preferably a set of fasteners. The plate cover 19 is mounted onto the heat sink 24 by the releasable attachment mechanism 29. This arrangement allows an individual to disengage the releasable attachment mechanism 29 and to subsequently remove the plate cover 19 when the at least one illumination system 1 requires maintenance or needs to be replaced.

Figure 3:
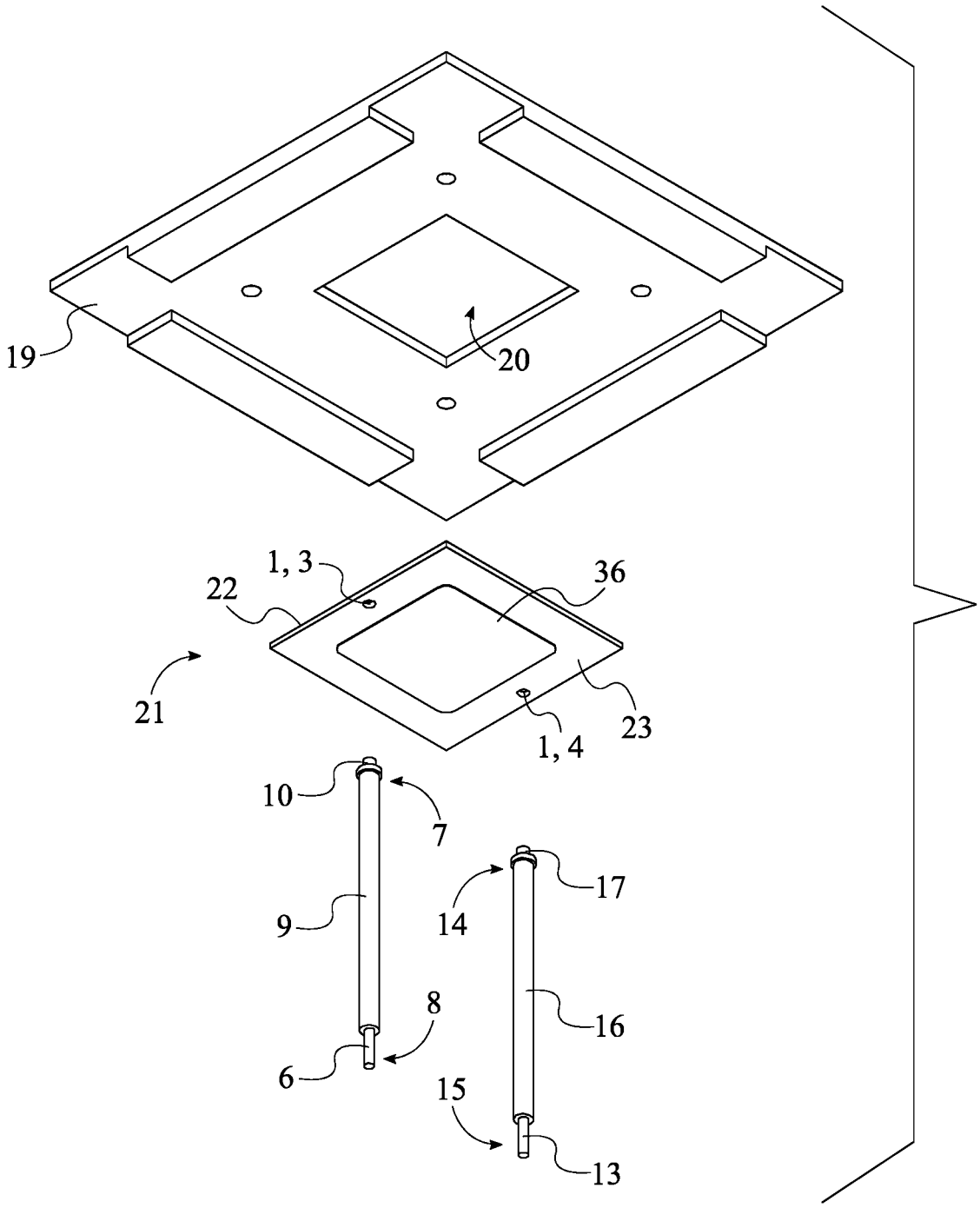
FIG. 3 is an exploded bottom perspective view of the present invention displaying the plate cover, the substrate, the first contact, the second contact, the first electrical conduit, and the second electrical conduit.
Figure 4:
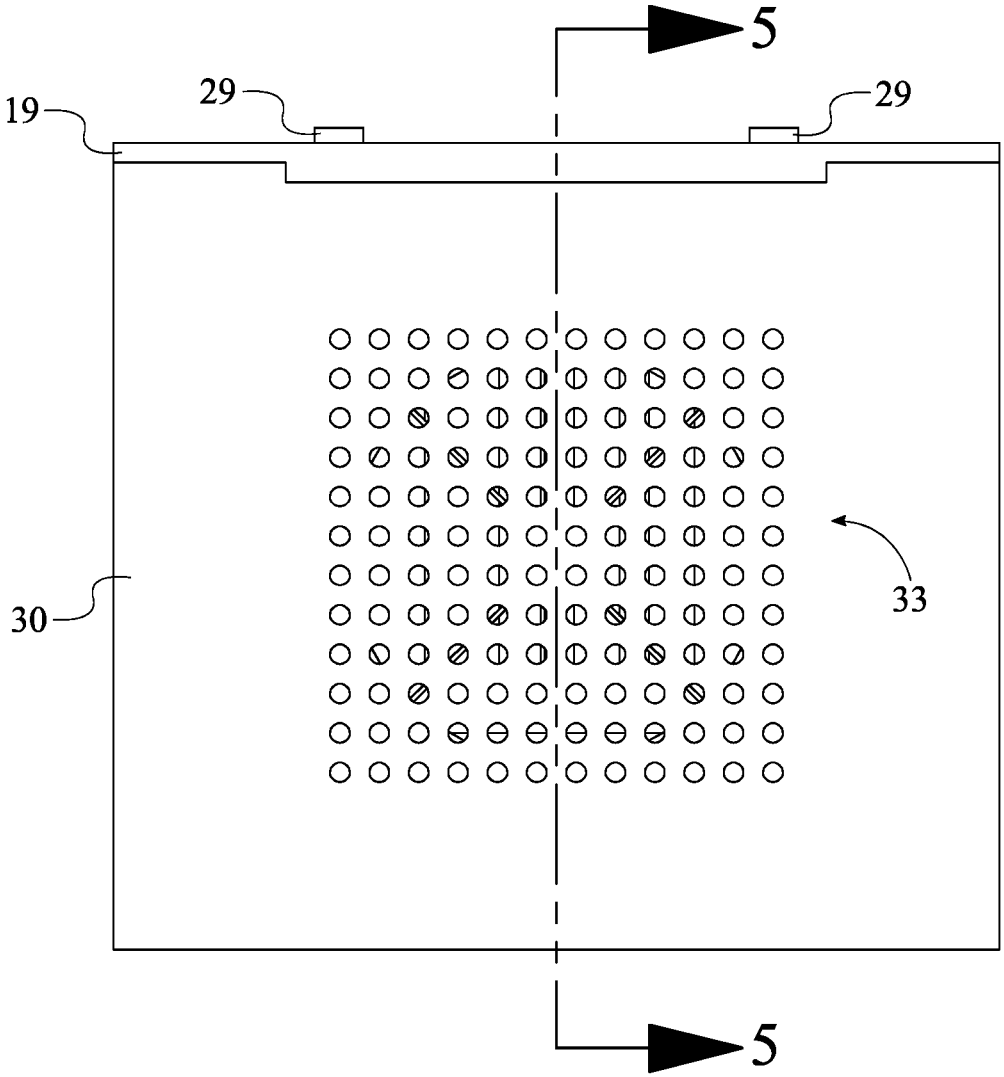
FIG. 4 is a side view of the present invention.

With reference to FIGS. 1 and 3, the plate cover 19 comprises an aperture 20 that traverses through the center of the plate cover 19. The aperture 20 allows light produced by the LED assembly 2 to be emitted by the present invention. Thus, the LED assembly 2 is aligned into the aperture 20 of the plate cover 19.

With reference to FIG. 6, the at least one illumination system 1 further comprises a first electrical conduit 5 and a first channel 11. The first electrical conduit 5 allows the DC power supply 28 to be electrically connected to the first contact 3. The first channel 11 is a passageway that allows the first electrical conduit 5 to reach the first contact 3 through the heat sink 24. Thus, the first channel 11 traverses through the heat sink 24 towards the first contact 3, and the first electrical conduit 5 is positioned within the first channel 11. Further, the first contact 3 is electrically connected to the DC power supply 28 through the first electrical conduit 5. Thus, the DC power supply 28 is able to electrify the first contact 3.

With reference to FIG. 2, the first electrical conduit 5 comprises a first conductive rod 6, a first insulative cover 9, and a first pogo pin 10. The first conductive rod 6 is used to pass electrical energy from the DC power supply 28 to the first contact 3. The first conductive rod 6 is preferably made of copper to optimize the conduction of electrical energy. The first insulative cover 9 is used to insulate the electrical energy being passed through the first conductive rod 6 and, thus, prevent the heat sink 24 from being electrified. The first pogo pin 10 is used to provide a compressive force in order to mitigate vibrations produced by the LED assembly 2 when in use. The first conductive rod 6 comprises a first proximal end 7 and a first distal end 8. The first conductive rod 6 is sleeved by the first insulative cover 9 in order to prevent the heat sink 24 from being electrified when electrical energy is passed from the DC power supply 28 to the first contact 3. The first pogo pin 10 is connected onto the first proximal end 7 and is pressed against the first contact 3. This arrangement positions the first pogo pin 10 in order to establish the electrical connection between the first contact 3 and the DC power supply 28. Additionally, this arrangement allows the first pogo pin 10 to provide a compressive force to the second face 23 in order to mitigate vibrations produced by the at least one illumination system 1. Moreover and with reference to FIG. 5, the first distal end 8 is electrically connected to the DC power supply 28 in order for the first conductive rod 6 to pass electrical energy from the DC power supply 28 to the first contact 3.

Similarly and with reference to FIG. 6, the at least one illumination system 1 further comprises a second electrical conduit 12 and a second channel 18. The second electrical conduit 12 allows the DC power supply 28 to be electrically connected to the second contact 4. The second channel 18 is a passage that allows the second electrical conduit 12 to reach the second contact 4 through the heat sink 24. Thus, the second channel 18 traverses through the heat sink 24 towards the second contact 4, and the second electrical conduit 12 is positioned within the second channel 18. Further, the second contact 4 is electrically connected to the DC power supply 28 through the second electrical conduit 12. Thus, the DC power supply 28 is able to electrify the second contact 4.

With reference to FIG. 2, the second electrical conduit 12 comprises a second conductive rod 13, a second insulative cover 16, and a second pogo pin 17. The second conductive rod 13 is used to pass electrical energy from the DC power supply 28 to the second contact 4. The second conductive rod 13 is preferably made of copper to optimize the conduction of electrical energy. The second insulative cover 16 is used to insulate the electrical energy being passed through the second conductive rod 13 and, thus, prevent the heat sink 24 from being electrified. The second pogo pin 17 is used to provide a compressive force in order to mitigate vibrations produced by the LED assembly 2 when in use. The second conductive rod 13 comprises a second proximal end 14 and a second distal end 15. The second conductive rod 13 is sleeved by the second insulative cover 16 in order to prevent the heat sink 24 from being electrified when electrical energy is passed from the DC power supply 28 to the second contact 4. The second pogo pin 17 is connected onto the second proximal end 14 and is pressed against the second contact 4. This arrangement positions the second pogo pin 17 in order to establish the electrical connection between the second contact 4 and the DC power supply 28. Additionally, this arrangement allows the second pogo pin 17 to provide a compressive force to the second face 23 in order to mitigate vibrations produced by at least one illumination system 1. Moreover and with reference to FIG. 5, the second distal end 15 is electrically connected to the DC power supply 28 in order for the second conductive rod 13 to pass electrical energy from the DC power supply 28 to the second contact 4.

With reference to FIGS. 1 and 2, the present invention may further comprise an enclosing receptacle 30 in order to protect and conceal the heat sink 24 and the DC power supply 28. Thus, the heat sink 24 and DC power supply 28 are positioned within the enclosing receptacle 30. This arrangement further provides electrical safety measures for the present invention. The plate cover 19 is perimetrically mounted to a rim 31 of the enclosing receptacle 30. This arrangement protects and conceals the at least one illumination system 1 and the substrate 21. The plate cover 19 may be mounted to the enclosing receptacle 30 through a variety of methods including, but not limited to, using a set of fasteners, or being press-fitted.

With reference to FIG. 2, the present invention may further comprise at least one cooling assembly 32 in order to dissipate heat that is absorbed by the heat sink 24. The at least one cooling assembly 32 comprises a vent 33 and a fan 34. The vent 33 allows heat to be released from the present invention. The fan 34 is used to improve airflow within the present invention. Further, the fan 34 is used to directly cool the heat sink 24 and to direct heat out of the present invention. In order for the vent 33 to release heat from the present invention, the vent 33 is integrated into the enclosing receptacle 30. The fan 34 is mounted within the enclosing receptacle 30, adjacent to the vent 33. This arrangement allows the fan 34 to direct heat out of the present invention. Further and with reference to FIG. 6, in order for the fan 34 to be electrically powered, the fan 34 is electrically connected to the DC power supply 28.

With reference to FIG. 2, the present invention may further comprise an electrically-insulating plate 35 in order to prevent the heat sink 24 from being electrified when the LED assembly 2 is powered on. The electrically-insulating plate 35 is compressed in between the second face 23 and the heat sink 24. This arrangement prevents electricity from being conducted between the at least one illumination system 1 and the heat sink 24.

With reference to FIGS. 2 and 3, the present invention may further comprise a quantity of thermal paste 36 in order to improve the heat transfer between the at least one illumination system 1 and the heat sink 24. The LED assembly 2 is in thermal communication with the heat sink 24 by the quantity of thermal paste 36. This arrangement allows the heat produced by the LED assembly 2 to be efficiently transferred to the heat sink 24 in order to prevent thermal failure of the at least one illumination system 1.

With reference to FIG. 2, the heat sink 24 may further comprise a first plate 25, a second plate 26, and a plurality of fin pins 27. The first plate 25 is positioned adjacent to the second face 23 and is preferably made of copper. This improves heat conduction between the at least one illumination system 1 and the heat sink 24. The second plate 26 is positioned adjacent to the first plate 25, opposite to the second face 23, and is preferably made of aluminum. This allows the heat sink 24 to dissipate heat transferred from the at least one illumination system 1. The plurality of fin pins 27 is connected normal to the second plate 26, opposite to the first plate 25, and is oriented away from the first plate 25. Further, the plurality of fin pins 27 is evenly distributed across the second plate 26. The plurality of fin pins 27 further improves the heat dissipation of the heat sink 24, and, thus, this arrangement efficiently removes heat transferred from the at least one illumination system 1.

The main objective of the present invention is to allow easy maintenance and replacement of a LED-COB. This can be accomplished using the following instructions. An individual can easily remove the at least one illumination system 1 by first removing the enclosing receptacle 30 from the plate cover 19. After this step is done, the individual can remove the plate cover 19 from the heat sink 24 which will expose the substrate 21 with the at least one illumination system 1. Then, the individual can disconnect the at least one illumination system 1 from the DC power supply 28 by disconnecting the first electrical conduit 5 from the first contact 3 and by disconnecting the second electrical conduit 12 from the second contact 4. The quantity of thermal paste 36 must be cleaned off the heat sink 24 after the substrate 21 with the at least one illumination system 1 is removed. Now, the individual can provide maintenance to the at least one illumination system 1 or replace the at least one illumination system 1. Additionally, the individual can remove the at least one illumination system 1 if the individual simply desires to use a different LED assembly 2 or a newer version of a LED assembly 2.

Although the invention has been explained in relation to its preferred embodiment, it is to be understood that many other possible modifications and variations can be made without departing from the spirit and scope of the invention as hereinafter claimed.

What is claimed is:

1. A light emitting diode (LED) lighting system, comprising:

at least one illumination system;

a plate cover;

a substrate;

a heat sink; and a direct current (DC) power supply;

wherein the at least one illumination system comprises an LED assembly, a first contact, a second contact, a first electrical conduit, and a first channel;

wherein the first electrical conduit comprises a first conductive rod, a first insulative cover, and a first pogo pin;

the first conductive rod comprises a first proximal end and a first distal end;

the first conductive rod being sleeved by the first insulative cover;

the first pogo pin being connected onto the first proximal end;

the first pogo pin being pressed against the first contact;

the first distal end being electrically connected to the DC power supply;

wherein the substrate comprises a first face and a second face;

the LED assembly being mounted onto the first face;

the first contact and the second contact being mounted onto the second face;

the plate cover being positioned adjacent to the first face;

the heat sink being positioned adjacent to the second face;

the DC power supply being positioned adjacent to the heat sink, opposite to the second face;

the substrate being compressed in between the plate cover and the heat sink;

the LED assembly being in thermal communication with the heat sink;

the first contact and the second contact being electrically connected to the DC power supply; and the electrical connection between the first contact, the second contact, and the first channel traversing through the heat sink towards the first contact;

the first electrical conduit being positioned within the first channel; and the first contact being electrically connected to the DC power supply through the first electrical conduit.

2. The LED lighting system as claimed in claim 1 comprises:

a releasable attachment mechanism; and the plate cover being mounted onto the heat sink by the releasable attachment mechanism.

3. The LED lighting system as claimed in claim 1 comprises:

the LED assembly being aligned into an aperture of the plate cover.

4. The LED lighting system as claimed in claim 1 comprises:

the at least one illumination system further comprises a second electrical conduit and a second channel;

the second channel traversing through the heat sink towards the second contact;

the second electrical conduit being positioned within the second channel; and the second contact being electrically connected to the DC power supply through the second electrical conduit.

5. The LED lighting system as claimed in claim 4 comprises:

the second electrical conduit comprises a second conductive rod, a second insulative cover, and a second pogo pin;

the second conductive rod comprises a second proximal end and a second distal end;

the second conductive rod being sleeved by the second insulative cover;

the second pogo pin being connected onto the second proximal end;

the second pogo pin being pressed against the second contact; and the second distal end being electrically connected to the DC power supply.

6. The LED lighting system as claimed in claim 1 comprises:

an enclosing receptacle;

the heat sink and the DC power supply being positioned within the enclosing receptacle; and the plate cover being perimetrically mounted to a rim of the enclosing receptacle.

7. The LED lighting system as claimed in claim 6 comprises:

at least one cooling assembly;

the at least one cooling assembly comprises a vent and a fan;

the vent being integrated into the enclosing receptacle;

the fan being mounted within the enclosing receptacle, adjacent to the vent; and the fan being electrically connected to the DC power supply.

8. The LED lighting system as claimed in claim 1 comprises:

an electrically-insulating plate; and the electrically-insulating plate being compressed in between the second face and the heat sink.

9. The LED lighting system as claimed in claim 1 comprises:

a quantity of thermal paste; and the LED assembly being in thermal communication with the heat sink by the quantity of thermal paste.

10. The LED lighting system as claimed in claim 1 comprises:

the heat sink comprises a first plate, a second plate, and a plurality of fin pins;

the first plate being positioned adjacent to the second face;

the second plate being positioned adjacent to the first plate, opposite to the second face;

the plurality of fin pins being connected normal to the second plate, opposite to the first plate;

the plurality of fin pins being oriented away from the first plate; and the plurality of fin pins being evenly distributed across the second plate.

11. The LED lighting system as claimed in claim 10 comprises:

the first plate being made of copper.

12. The LED lighting system as claimed in claim 10 comprises:

the second plate being made of aluminum.

13. A light emitting diode (LED) lighting system, comprising:

an illumination system including an LED assembly, a substrate, and a first contact on the substrate;

a heat sink having a first channel; and a first electrical conduit including a first conductive rod, a first insulative cover, and a first pogo pin attached to the first conductive rod;

wherein the first electrical conduit and the first conductive rod extend through the first channel to connect with a DC power supply, wherein the first pogo pin is pressed against the first contact to electrically connect the illumination system to the DC power supply.

14. The LED lighting system as claimed in claim 13, comprising:

a second electrical conduit including a second conductive rod, a second insulative cover, and a second pogo pin attached to the second conductive rod;

wherein the illumination system comprises a second contact on the substrate;

wherein the heat sink comprises a second channel; and wherein the second electrical conduit and the second conductive rod extend through the second channel to connect with the DC power supply, wherein the second pogo pin is pressed against the second contact to electrically connect the illumination system to the DC power supply.

15. The LED lighting system as claimed in claim 13, comprising:

an enclosing receptacle;

wherein the heat sink is positioned within the enclosing receptacle; and a plate cover being perimetrically mounted to a rim of the enclosing receptacle, the plate cover having an aperture, the plate cover providing a compressive force to press the first pogo pin against the first contact.

16. A reusable light emitting diode (LED) system, comprising:

an enclosing receptacle having a removeable plate cover, wherein the removeable plate cover includes an aperture;

a heat sink disposed within the enclosing receptacle, the heat sink having a first channel; and a first electrical conduit including a first conductive rod and a first pogo pin attached to a first end of the first conductive rod;

wherein the first electrical conduit and the first conductive rod extend through the first channel to connect with a DC power supply, wherein the first pogo pin attached to the first end of the first conductive rod is configured to be pressed against a first contact of an LED illumination system when the LED illumination system is placed within the enclosing receptacle to connect the DC power supply and the LED illumination system, wherein the removeable plate cover is configured to provide a compressive force to press the first contact of the LED illumination system against the first pogo pin.

17. The reusable light emitting diode (LED) system as claimed in claim 16, comprising:

a second electrical conduit including a second conductive rod and a second pogo pin attached to a first end of the second conductive rod;

wherein the heat sink comprises a second channel; and wherein the second electrical conduit and the second conductive rod extend through the second channel to connect with the DC power supply, wherein the second pogo pin is pressed against a second contact of the LED illumination system when the LED illumination system is placed within the enclosing receptacle to connect the DC power supply and the LED system, wherein the removeable plate cover is configured to provide a compressive force to press the second contact of the LED illumination system against the second pogo pin.

18. The reusable light emitting diode (LED) system as claimed in claim 16, comprising:

at least one cooling assembly, the at least one cooling assembly comprising a vent and a fan;

wherein the vent is integrated into the enclosing receptacle;

wherein the fan is disposed within the enclosing receptacle; and wherein the fan is electrically connected to the DC power supply.

* * * * *